US008965002B2

(12) United States Patent
Oh et al.

(10) Patent No.: US 8,965,002 B2
(45) Date of Patent: Feb. 24, 2015

(54) APPARATUS AND METHOD FOR ENHANCING AUDIO QUALITY USING NON-UNIFORM CONFIGURATION OF MICROPHONES

(75) Inventors: Kwang-Cheol Oh, Yongin-si (KR); Jeong-Su Kim, Yongin-si (KR); Jae-Hoon Jeong, Yongin-si (KR); So-Young Jeong, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 550 days.

(21) Appl. No.: 13/114,746

(22) Filed: May 24, 2011

(65) Prior Publication Data

US 2012/0070015 A1 Mar. 22, 2012

(30) Foreign Application Priority Data

Sep. 17, 2010 (KR) ..... 10-2010-0091920

(51) Int. Cl.
*H04R 3/00* (2006.01)
*G10L 21/0208* (2013.01)
*G10L 21/0216* (2013.01)

(52) U.S. Cl.
CPC ... *G10L 21/0208* (2013.01); *G10L 2021/02166* (2013.01)
USPC ..... 381/92; 381/122; 367/118

(58) Field of Classification Search
CPC ..... H04R 3/00
USPC ..... 381/91–92, 163, 356, 94.1–94.3; 367/12, 118, 119
See application file for complete search history.

(56) References Cited

U.S. PATENT DOCUMENTS 7,099,821 B2 8/2006 Visser et al.
7,464,029 B2 12/2008 Visser et al.
(Continued)

FOREIGN PATENT DOCUMENTS

EP 1 640 971 3/2006
JP 2010-091912 4/2010
KR 1020090098426 9/2009
KR 10-2010-0053890 5/2010

OTHER PUBLICATIONS

Mizumachi, Mitsunori, et al. "Noise Reduction using Paired-microphones on Non-equally-spaced Microphone Arrangement." Sep. 1, 2003, p. 585, XP007006702.
(Continued)

*Primary Examiner* — Disler Paul
(74) *Attorney, Agent, or Firm* — NSIP Law

(57) ABSTRACT

An audio quality enhancing apparatus and method is provided in which a microphone array has a non-uniform configuration and thus a beam pattern of a desired direction is obtained in a wide range of frequencies including higher frequency bands and lower frequency bands even when the microphone array is relatively small. The audio quality enhancing apparatus includes at least three microphones which are disposed in a non-uniform configuration, a frequency conversion unit configured to transform acoustic signals input from the at least three microphones to acoustic signals of frequency domain; a band division and merging unit configured to divide frequencies of the transformed acoustic signals into bands based on intervals between the at least three microphones and to merge the acoustic signals in the frequency domain into signals of two channels based on the divided frequency bands; and a two channel beamforming unit configured to reduce noise of signals including input from a direction other than the direction of a target sound by performing beamforming on the signals of the two channels and to output the noise-reduced signals.

23 Claims, 8 Drawing Sheets

(56) References Cited

U.S. PATENT DOCUMENTS

| | | | | |
|---|---|---|---|---|
| 7,792,313 | B2 * | 9/2010 | Dedieu et al. | 381/92 |
| 2008/0159559 | A1 * | 7/2008 | Akagi et al. | 381/92 |
| 2010/0119079 | A1 | 5/2010 | Kim et al. | |
| 2011/0286609 | A1 * | 11/2011 | Faller | 381/92 |
| 2012/0070015 | A1 * | 3/2012 | Oh et al. | 381/92 |

OTHER PUBLICATIONS

Bedrosian, S. D. "Nonuniform linear arrays: Graph-theoretic approach to minimum redundancy." Proceedings of the IEEE, vol. 74, No. 7, Jan. 1, 1986, pp. 1040-1043, XP55014925.

Pallas, M.A., et al. "Nearfield noise source localization with constant directivity arrays: a comparison—Application to tram noise," NAG/DAGA 2009, Mar. 23, 2009, pp. 100-1-3, XP55014929, Roterdamn. http://perception.inrialpes.fr/people/Perrier/siteoueb/articles/PALLAS_NAGDADA09.pdf (retrieved on Dec. 15, 2011).

Search report issued on Dec. 21, 2011, in corresponding European Patent Application No. 11181569.2-1224.

Aarabi, et al., "Phase-Based Dual-Microphone Robust Speech Enhancement," IEEE Transactions on Systems, Man, and Cybernetics—Part B: Cybernetics, vol. 34, No. 4, Aug. 2004, pp. 1763-1773.

Boll, "Suppression of Acoustic Noise in Speech Using Spectral Subtraction," *IEEE Transactions on Acoustics, Speech, and Signal Processing*, vol. ASSP-27, No. 2, Apr. 1979, pp. 113-120.

* cited by examiner

FIG. 3

| MICROPHONE INTERVAL (INDEX) | MICROPHONE INTERVAL (m) | $\lambda=2\times d$ | MAXIMUM FREQUENCY | FREQUENCY |
|---|---|---|---|---|
| 1 | 0.02 | 0.04 | 8500 | 8500 |
| 2 | 0.04 | 0.08 | 4250 | 4220 |
| 3 | 0.06 | 0.12 | 2833 | 2810 |
| 4 | 0.08 | 0.16 | 2125 | 2090 |
| 5 | 0.1 | 0.20 | 1700 | 1690 |
| 6 | 0.12 | 0.24 | 1417 | 1400 |

APPARATUS AND METHOD FOR ENHANCING AUDIO QUALITY USING NON-UNIFORM CONFIGURATION OF MICROPHONES

CROSS-REFERENCE TO RELATED APPLICATION

This application claims the benefit under 35 U.S.C. §119 (a) of Korean Patent Application No. 10-2010-0091920, filed on Sep. 17, 2010, the disclosure of which is incorporated herein by reference in its entirety for all purposes.

BACKGROUND

1. Field

The following description relates to acoustic signal processing, and more particularly, to an apparatus and method for enhancing audio quality by alleviating noise using a non-uniform configuration of microphones.

2. Description of the Related Art

As mobile convergence terminals including high-tech medical equipment, such as high precision hearing aids, mobile phones, ultra mobile personal computers (UMPCs), camcorders, etc. have become more prevalent today, the demand for products using a microphone array has increased. A microphone array includes multiple microphones arranged to obtain sound and supplementary features of sound, such as directivity (e.g., the direction of sound or the location of sound sources). Directivity may be used to increase sensitivity to a signal emitted from a sound source located in a predetermined direction by use of the difference between the times of arrival of sound source signals at each of the multiple microphones constituting the microphone array. By obtaining sound source signals using the principal of directivity in a microphone array, a sound source signal input from a predetermined direction may be enhanced or suppressed.

Recent studies have been directed toward: a method of improving a voice call quality and recording quality through directed noise cancellation; a teleconference system and intelligent conference recording system capable of automatically estimating and tracking the location of a speaker; and robot technology for tracking a target sound.

Beamforming algorithm-based noise cancellation is one technique applied to most microphone array algorithms. As an example of the beamforming noise cancellation method, a fixed beamforming technique is used for beamforming that is independent of characteristics of the input signals. According to the fixed beamforming technique, a beam pattern varies depending on the size of a microphone array and the number of elements or microphones included in the microphone array. Desirable beam patterns for lower frequency bands may be obtained using a larger microphone array, but beam patterns become omni-directional when a smaller microphone array is used. However, side lobes or grating lobes occur in conjunction with higher frequency bands when a larger microphone array is used. As a result, sound in an unwanted direction is acquired.

A conventional microphone array uses at least ten microphones to form a desired beam pattern. However, this increases the cost of manufacturing the microphone array and the application of acoustic signal processing of the microphone array.

SUMMARY

In one aspect, there is provided an apparatus and method for enhancing audio quality for a microphone array having a non-uniform configuration and thus a beam pattern of a desired direction is obtained in a wide range of frequencies including higher frequency bands and lower frequency bands even when the microphone array is small.

In one general aspect, an apparatus for enhancing audio quality includes at least three microphones, a frequency conversion unit, a band division and merging unit, and a two channel beamforming unit. The at least three microphones which are disposed in a non-uniform configuration. The frequency conversion unit configured to transform acoustic signals input from the at least three microphones to acoustic signals of frequency domain. The band division and merging unit configured to divide frequencies of the transformed acoustic signals into bands based on intervals between the at least three microphones and to merge the acoustic signals in the frequency domain into signals of two channels based on the divided frequency bands. The two channel beamforming unit configured to reduce noise of signals including input from a direction other than the direction of a target sound by performing beamforming on the signals of the two channels and to output the noise-reduced signals.

The at least three microphones may be disposed according to a minimum redundant linear array configuration that minimizes a redundant component for an interval between the at least three microphones.

The band division and merging unit may divide the frequencies into bands for the transformed acoustic signals based on the respective intervals of the at least three microphones. The frequency bands may be assigned using the maximum frequency value that does not cause spatial aliasing for each corresponding interval of the at least three microphones.

The band division and merging unit may determine the maximum frequency value ($f_o$) of a band to be less than a value obtained by dividing a sound velocity (c) by twice the interval between the corresponding microphones (d).

The number of frequency bands configured by the band division and margining unit may be determined to correspond to the number of intervals of various pairs of the at least three microphones.

The band division and merging unit is further configured to extract acoustic signals in the frequency domain that are input from a set of two of the at least three microphones forming an interval for all sets of intervals of the at least three microphones of each frequency band and to merge the extracted acoustic signals into acoustic signals of two channels.

The apparatus also may include an inverse frequency conversion unit configured to transform the output noise-reduced signals into acoustic signals of a time domain.

In another general aspect, an apparatus for enhancing audio quality includes: at least three microphones, a filtering unit, a frequency conversion unit, a two channel beamforming unit, a merging unit, and an inverse frequency conversion unit. The at least three microphones disposed in a non-uniform configuration. The filtering unit includes a plurality of band-pass filters configured to allow acoustic signals input from the at least three microphones to pass through respective frequency bands of the plurality of band-pass filters, wherein the range of frequencies corresponding to each band-pass filter is determined based on intervals between the at least three microphones. The frequency conversion unit is configured to transform the acoustic signals having passed through the filtering unit into acoustic signals of a frequency domain. The two channel beamforming unit is configured to reduce noise input from a direction other than a direction of a target sound of acoustic signals of two channels for each frequency band, the acoustic signals having passed through a same band-pass filter among the plurality of band-pass filters. The merging unit is configured to merge the noise reduced acoustic signals output for each frequency band. The inverse frequency conversion unit is configured to transform the merged signals into acoustic signals of a time domain.

The at least three microphones may be configured according to a minimum redundant linear array to minimize a redundant component for the intervals of the at least three microphones.

The range of frequencies corresponding to each band-pass filter band-pass filters included in the filtering unit may be determined by use of maximum frequency values that do not cause spatial aliasing for each corresponding interval of the at least three microphones.

In yet another general aspect, a method of enhancing audio quality of an acoustic array comprises: transforming acoustic signals input from at least three microphones disposed in a non-uniform configuration into acoustic signals of the frequency domain; dividing a range of frequencies of the acoustic signals of frequency domain into frequency bands based on intervals between the microphones; merging the acoustic signals of the frequency domain into two channel signals based on the frequency bands; reducing noise of the acoustic signals input from a direction other than a direction of a target sound by use of the two channel signals; and outputting the noise reduced signals.

The transforming of acoustic signals input from at least three microphones disposed in a non-uniform configuration may include disposing the at least three microphones according to a minimum redundant linear array configuration to minimize a redundant component for the interval between the microphones.

The dividing of the range of frequencies of the acoustic signals of frequency domain into frequency bands based on intervals between the microphones also may include determining the frequency bands by use of a maximum frequency value that does not cause spatial aliasing for each corresponding interval of the microphones.

The determining the frequency bands by use of a maximum frequency value that does not cause spatial aliasing for each corresponding interval of the microphones may include determining the maximum frequency value ($f_o$) of a band to be less than a value obtained by dividing a sound velocity (c) by twice a corresponding interval of microphones (d).

The dividing of the range of frequencies of the acoustic signals of frequency domain into frequency bands based on intervals between the microphones may include dividing the frequency range of frequencies into bands corresponding to the number of intervals of the microphones.

The merging the acoustic signals of the frequency domain into two channel signals may include extracting acoustic signals in the frequency domain that are input from a set of two of the at least three microphones forming an interval for all sets of intervals of the at least three microphones of each frequency band; and merging the extracted acoustic signals into acoustic signals of two channels.

The method may further comprise transforming the output noise-reduced signals into acoustic signals of a time domain.

In yet another general aspect, a method of enhancing audio quality of an acoustic array including at least three microphones disposed in a non-uniform configuration comprises: allowing acoustic signals input from the at least three microphones to pass through respective frequency bands of a plurality of band-pass filters, wherein the range of frequencies corresponding to each band-pass filter is determined based on intervals between the at least three microphones; transforming the acoustic signals into acoustic signals of a frequency domain; reducing noise input from direction other than a direction of a target sound of acoustic signals of two channels for each frequency band, the acoustic signals having passed through a same band-pass filter among the plurality of band-pass filters; merging the noise-reduced acoustic signals output for each frequency band; and transforming the merged noise-reduced acoustic signals into acoustic signals of time domain.

The at least three microphones may be configured according to a minimum redundant linear array to minimize a redundant component for the intervals of the at least three microphones.

The allowing of the acoustic signals to pass through the respective frequency bands may include: passing acoustic signals through the respective frequency bands that are determined by use of the maximum frequency value that does not cause spatial aliasing for each corresponding interval of the at least three microphones.

Other features will become apparent to those skilled in the art from the following detailed description, which, taken in conjunction with the attached drawings, discloses exemplary embodiments of the invention.

BRIEF DESCRIPTION OF THE DRAWINGS

FIG. 3 illustrates an example of frequency regions assigned for microphone intervals without spatial aliasing.

Elements, features, and structures are denoted by the same reference numerals throughout the drawings and the detailed description, and the size and proportions of some elements may be exaggerated in the drawings for clarity and convenience.

DETAILED DESCRIPTION

The following detailed description is provided to assist the reader in gaining a comprehensive understanding of the methods, apparatuses and/or systems described herein. Various changes, modifications, and equivalents of the systems, apparatuses and/or methods described herein will suggest themselves to those of ordinary skill in the art. Descriptions of well-known functions and structures are omitted to enhance clarity and conciseness.

Hereinafter, examples will be described with reference to accompanying drawings in detail.

Figure 1:
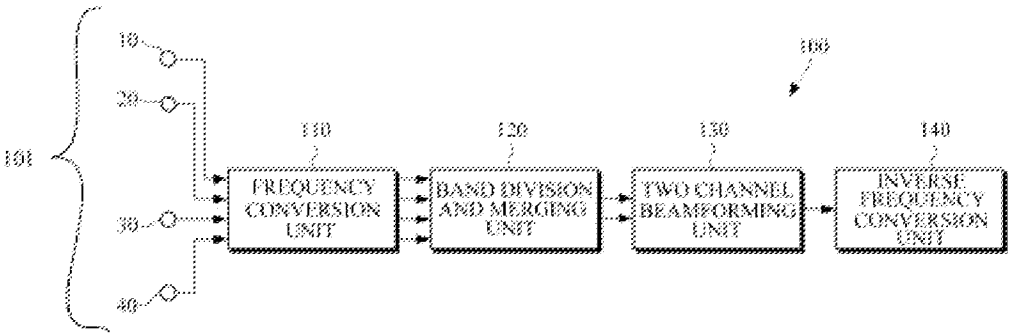
FIG. 1 illustrates an example of a configuration of an apparatus for enhancing audio quality.

FIG. 1 is a view showing an example of a configuration of an apparatus for enhancing audio quality.

An audio quality enhancing apparatus 100 includes a microphone array 101 including a plurality of microphones 10, 20, 30, and 40, a frequency conversion unit 110, a band division and merging unit 120, a two channel beamforming unit 130 and an inverse frequency conversion unit 140. The audio quality enhancing apparatus 100 may be implemented using various types of electronic equipment, such as, for example, a personal computer, a server computer, a handheld or laptop device, a mobile or smart phone, a multiprocessor system, a microprocessor system or a set-top box.

The microphone array 101 may be implemented using at least three microphones. Each microphone may include a sound amplifier to amplify acoustic signals and an analog/digital converter to convert input acoustic signals to electrical signals. The example of an audio quality enhancing apparatus 100 shown in FIG. 1 includes four microphones, but the number of microphones is not limited thereto; however, the audio quality enhancing apparatus 100 should include at least three microphones.

The microphones 10, 20, 30 and 40 are disposed in a non-uniform configuration. In addition, the microphones 10, 20, 30 and 40 may be disposed according to a minimum redundant linear array configuration to minimize a redundant component for the interval of the microphones 10, 20, 30 and 40. A non-uniform configuration of a microphone array may be used to avoid drawbacks of spatial aliasing due to grating lobes associated with higher frequency regions. On the other hand, beam patterns typically lose uni-directional characteristics associated with lower frequency regions when the interval between microphones is reduced and the size of the microphone array is small. However, such drawbacks also may be avoided according to the detailed description provided herein. Further details of the minimum redundant linear array configuration are described below with reference to FIG. 2.

The microphones 10, 20, 30 and 40 may be disposed on the same plane of the audio quality enhanced apparatus 100. For example, all of the microphones 10, 20, 30 and 40 may be disposed on a front side plane or a lateral side plane of the audio quality enhancing apparatus 100.

The frequency conversion unit 110 receives acoustic signals of time domain from respective microphones 10, 20, 30 and 40 and transforms the received acoustic signals of time domain into acoustic signals of frequency domain. For example, the frequency conversion unit 110 may transform acoustic signals of time domain into acoustic signals of frequency domain by use of a discrete Fourier transform (DFT) or a fast Fourier transform (FFT).

The frequency conversion unit 110 may compose acoustic signals into a frame and transform the acoustic signals in frame units into acoustic signals of the frequency domain. A unit of framing may vary depending on variables, such as the sampling frequency and the type of application.

The band division and merging unit 120 divides the frequency range of the transformed acoustic signals into bands based on the intervals of the microphones 10, 20, 30 and 40 and merges the transformed acoustic signals into two channel signals based on where the transformed acoustic signals fall within the divided frequency bands. When dividing the frequency bands for the transformed acoustic signals based on the respective intervals of the microphones, the band division and merging unit 120 may divide the frequency range into bands based on the maximum frequency value that does not cause spatial aliasing for each interval of the microphones.

The band division and merging unit 120 determines the maximum frequency value ($f_o$) of a range to be less than the value determined by dividing a sound velocity (c) by twice the interval between the microphones (d). In addition, when dividing the frequencies of the transformed acoustic signals into bands based on the respective intervals of the microphones, the band division and merging unit 120 may assign the frequency bands to correspond with the number of the intervals of microphones. In all combinations of the intervals of microphones, the band division and merging unit 120 extracts acoustic signals from the frequency domain input of two microphones forming an interval of the array according to frequency bands assigned according to corresponding intervals of the microphones. The band division and merging unit 120 then merges the extracted acoustic signals into two channel acoustic signals. Details of an operation of the band division and merging unit 120 is described in further detail below with reference to FIGS. 3 and 4.

The two channel beamforming unit 130 outputs noise reduced signals by alleviating input noise from an unwanted direction without inhibiting sound from a direction of a target sound source using two channel beamforming. Two channel beamforming is performed by use of the two channel signals that are merged and input from the band division and merging unit 120. The two channel beamforming unit 130 may form beam patterns by use of the phase difference between the two channel signals.

When the two channel acoustic signals include a first signal $x_1(t, r)$ and a second signal $x_2(t, r)$, the phase difference ($\Delta P$) between the first signal $x_1(t, r)$ and the second signal $x_2(t, r)$ may be expressed as shown in Equation 1.

$$\begin{aligned}\Delta P &= \angle x_1(t, r) - \angle x_2(t, r) \\ &= \frac{2\pi}{\lambda} d\cos\theta_t \\ &= \frac{2\pi f}{c} d\cos\theta_t\end{aligned} \quad \text{[Equation 1]}$$

Here, c is the velocity of sound wave (330 m/s), f is the frequency of the sound wave, d is the distance between two microphones of the array, and $\theta_t$ is the direction angle of a sound source.

Assuming that the direction angle $\theta_t$ of a sound source corresponds to the direction angle $\theta_t$ of a target sound, and the direction angle $\theta_t$ of the target sound is known, the phase difference for each frequency may be predicted. The phase difference ($\Delta P$) of acoustic signals introduced from a predetermined position with a direction angle $\theta_t$ may vary depending on each frequency.

Meanwhile, an allowable angle range $\theta_\Delta$ of target sound (or a direction range of allowable target sound) including a direction angle $\theta_t$ of target sound may be set taking into consideration the influence of noise. For example, if the direction angle $\theta_t$ of a target sound is $\pi/2$, the allowable angle range $\theta_\Delta$ of target sound is set to about $5\pi/12$ to $7\pi/12$ taking into consideration the influence of noise. If the direction angle $\theta_t$ of a target sound is known and the allowable angle range $\theta_\Delta$ of target sound is determined, an allowable phase difference range of a target sound is calculated using Equation 1.

A lower threshold value $Th_L(m)$ and an upper threshold value $Th_H(m)$ of the allowable phase difference range of a target sound are defined as in Equation 2 and Equation 3, respectively.

$$Th_H(m) = \frac{2\pi f}{c} d\cos\left(\theta_t - \frac{\theta_\Delta}{2}\right) \quad \text{[Equation 2]}$$

$$Th_L(m) = \frac{2\pi f}{c} d\cos\left(\theta_t + \frac{\theta_\Delta}{2}\right) \quad \text{[Equation 3]}$$

Herein, m represents a frequency index and d represents the interval between microphones. Accordingly, the lower threshold value $Th_L(m)$ and the upper threshold value $Th_H(m)$ of the allowable phase difference range of a target sound may vary depending on the frequency (f), the interval between microphones (d) and the allowable angle range $\theta_\Delta$ of a target sound.

The direction angle $\theta_t$ of a target sound may be externally adjusted such as using a user's input signals through a user interface device. In addition, the allowable angle range of a target sound including the direction angle of a target sound also may be adjusted.

Taking into consideration the relationship between the allowable angle range of a target sound and the allowable phase difference range of a target sound, if a phase difference $\Delta P$ at a predetermined frequency of an input acoustic signal is present within the allowable phase difference range of a target sound, it is determined that the target sound is present at the predetermined frequency. If a phase difference $\Delta P$ at a predetermined frequency of a currently input acoustic signal is not present within the allowable phase difference range of a target sound, it is determined that the target sound is not present at the predetermined frequency.

The two channel beamforming unit 130 may extract a feature value representing the extent to which a phase difference at a determined frequency component is included in the allowable phase difference range of a target source. The feature value may be calculated by use of the number of phase differences for frequency components within the allowable phase difference range of a target sound. For example, the feature value is represented as a mean effective frequency component number that is determined by dividing the sum of the number of frequency components within an allowable phase difference range of a target sound for each frequency component by the total number (M) of frequency components.

As described above, if a direction angle $\theta_t$ of a target sound and an allowable angle range $\theta_\Delta$ of a target sound are input, the allowable phase difference range of a target sound is calculated in the two channel beamforming unit 130. Alternatively, the two channel beamforming unit 130 is provided with a predetermined storage space to store some information representing an allowable phase difference range of a target sound for each direction angle of a target sound and each allowable angle of a target sound.

If it is determined that a target sound is present at a predetermined frequency in a frame that is to be processed, the two channel beamforming unit 130 amplifies and outputs the corresponding frequency component. If it is determined that a target sound is not present at a predetermined frequency in a frame to be processed, the two channel beamforming unit 130 attenuates and outputs the corresponding frequency component. For example, the two channel beamforming unit 130 estimates an amplitude of a target sound for each frequency component of a frame to be analyzed. The estimated amplitude of a target sound for each frequency component is multiplied by the feature value. The feature value represents the extent to which a phase difference for each determined frequency component is present within the allowable phase difference range of a target sound. A frequency component determined not to include a target sound is attenuated from the estimated amplitude of a target sound for the determined frequency component. As a result, noise is alleviated or cancelled. Alternatively, the two channel beamforming unit 130 may alleviate noise by performing the two channel beamforming through other various types of methods generally known in the art.

The inverse frequency conversion unit 140 transforms output signals of the two channel beamforming unit 130 into acoustic signals of time domain. The transformed signals may be stored in a storage medium (not shown) or output through a speaker (not shown).

Although this example may avoid drawbacks of spatial aliasing due to grating lobes at higher frequency regions, beam patterns for lower frequency regions lose uni-directional characteristics when the interval between microphones is reduced and the size of the microphone array is small. However, if the number of microphones is increased, the cost associated with data processing of beamforming is increased. Therefore, the two channel beamforming described above provides cost effective beamforming even if the number of microphones is increased. According to the frequency band division and merging described above, at least three acoustic signals input into the microphones of a non-uniform configuration are effectively transformed into two acoustic signals for two channel beaming while still avoiding the spatial aliasing due to grating lobes associated with higher frequency regions.

Figure 2:
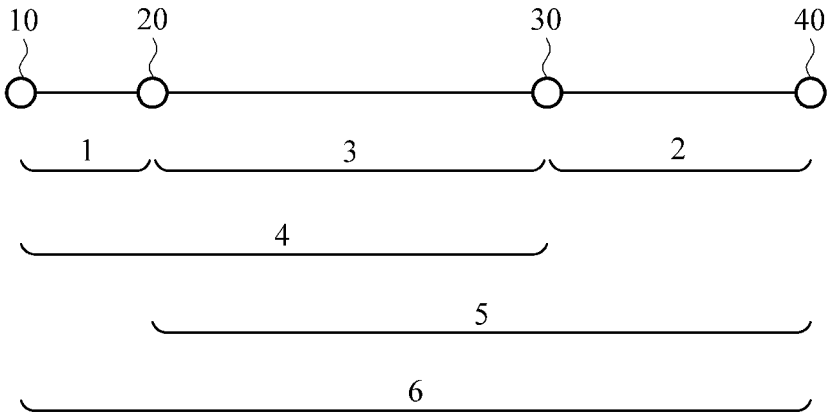
FIG. 2 illustrates an example of a minimum redundant array configuration.

FIG. 2 is a view showing an example of a minimum redundant array configuration.

Minimum redundant linear array is a technique derived from the structure of a radar antenna. The minimum redundant linear array represents an array structure of a non-uniform configuration where elements are disposed in a manner to minimize redundant components for the interval between the array elements. For example, when the array structure includes four array elements, six spatial sensitivities are obtained.

FIG. 2 shows the minimum redundant array configuration obtained when the microphone array 101 includes four microphones 10, 20, 30 and 40. As shown in FIG. 2, the microphone 10 and the microphone 20 are spaced apart from each other by a minimum interval. The minimum interval may be referred to as a fundamental interval. In this example, the interval between the microphone 30 and the microphone 40 is twice the fundamental interval, the interval between the microphone 20 and the microphone 30 is three times the fundamental interval, the interval between the microphone 10 and the microphone 30 is four times the fundamental interval, the interval between the microphone 20 and the microphone 40 is five times the fundamental interval, and the interval between the microphone 10 and the microphone 40 is six times the fundamental interval, as shown in FIG. 2. As a result, the intervals among the microphones 10, 20, 30 and 40 of the microphone array shown in FIG. 2 may vary in a range from one to six times the fundamental interval.

As mentioned above, although spatial aliasing due to grating lobes at higher frequency regions is avoided, beam patterns for lower frequency regions lose uni-directional characteristics using fixed beamforming when the interval between microphones is reduced and the size of the microphone array is small. However, the minimum interval of a minimum redundant linear array may be used to avoid drawbacks of spatial aliasing associated with higher frequency bands and the maximum interval capable of beamforming without distortion at lower frequency bands are easily obtained for the minimum redundant linear array. Therefore, the minimum redundant linear array may be constructed in various configurations depending on the number and arrangement of the microphones, as explained in further detail below.

FIG. 3 is a view showing an example of frequency regions assigned for microphone intervals without causing spatial aliasing.

For acoustics signals input from the microphones 10, 20, 30 and 40, the band division and merging unit 120 assigns frequency bands to each interval between the microphones 10, 20, 30 and 40 such that they do not cause spatial aliasing. When a predetermined interval between microphones is d, the maximum frequency value ($f_o$) is determined to be less than the value obtained by dividing a sound velocity (c) by twice the predetermined interval between microphones (d) as expressed by Equation 4.

$$f_o < \frac{c}{2 \times d} \quad \text{[Equation 4]}$$

For example, if the microphone interval (d) is 10 cm and the sound velocity (c) is 340 m/s, aliasing does not occur at a signal having a frequency ($f_o$) of 1700 Hz or less. According to the interval shown in FIG. 2, a largest interval, for example, the interval between the two outermost microphones, is suitable for a lower frequency, and a smallest interval between microphones is suitable for a higher frequency. Accordingly, the band division and merging unit 120 assigns frequency bands such that acoustic signals obtained by the microphones forming the largest interval are assigned the lowest frequency region, and the acoustic signals obtained by the microphones forming the second largest interval are assigned the second lowest frequency region, and so on. When the smallest interval between the microphones is 2 cm and the number of microphones is four, frequency bands are assigned as shown in FIG. 3.

For example, according to FIGS. 2 and 3, the microphones 10 and 40 that form the largest interval are configured to correspond to signals having frequencies of 1400 Hz or below. The is microphones 20 and 40 that form the second largest interval are configured to correspond to signals having frequencies 1417 to 1700 Hz. The microphones 10 and 30 that form the third largest interval are configured to correspond to signals having frequencies of 1700 to 2125 Hz. The microphones 20 and 30 that form the fourth largest interval are configured to correspond to signals having frequencies of 2125 to 2833 Hz. The microphones 30 and 40 that form the fifth largest interval are configured to correspond to signals having frequencies of 2833 to 4250 Hz. The microphones 10 and 20 that form the smallest interval are configured to correspond to signals having frequencies of 4250 to 8500 Hz.

Of course when the fundamental interval of the microphones is changed, the frequency band assigned to each interval will be changed. As mentioned above, the maximum frequency value is determined to be the maximum value that does not cause spatial aliasing, and thus the microphones forming each interval may be assigned a frequency that less than the determined maximum frequency. For example, the two outermost microphones 10 and 40 having the largest interval may be configured to correspond to 0 Hz to 1000 Hz rather than 0 Hz to 1400 Hz, and the two microphones 20 and 40 having the second largest interval may be configured to correspond to 1000 Hz to 1690 Hz rather than 1407 Hz to 1700 Hz, and so on. In this manner, the band division and merging unit 120 (see FIG. 1) assigns frequency bands for the respective intervals of the microphones of the microphone array.

Figure 4:
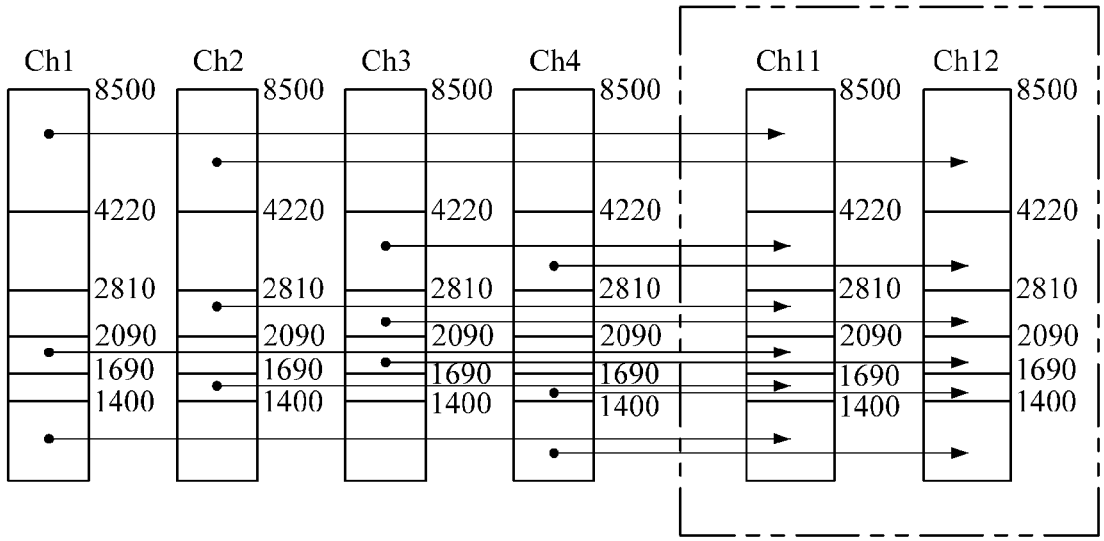
FIG. 4 illustrates an example of an operation of a band division and merging unit of the apparatus for enhancing audio quality of FIG. 1.

FIG. 4 is a view showing an example of data flow associated with a band division and merging unit of the apparatus for enhancing audio quality of FIG. 1.

In FIG. 4, the four microphones 10, 20, 30 and 40 are disposed in the minimum redundant linear array configuration as shown in FIGS. 1 and 2.

Four acoustic signals (e.g., Ch1, Ch2, Ch3, and Ch4) of the frequency domain obtained from the respective four microphones 10, 20, 30, and 40 are merged by mapping the four acoustic signals to two acoustic signals (e.g., Ch11 and Ch12) shown in the right portion of FIG. 4. The two acoustic signals, Ch11 and Ch12, of the frequency domain are the signals input to the two channel beamforming unit 130.

When the four microphones 10, 20, 30 and 40 are disposed in the minimum redundant linear array configuration, the frequencies are divided into six bands based on the intervals of the microphones 10, 20, 30, and 40. The six frequency bands are represented for each of the four acoustic signals Ch1, Ch2, Ch3 and Ch4 as shown in the left portion of FIG. 4 and each of the two acoustic signals Ch11 and Ch12 as shown in the right portion of FIG. 4.

According to the fundamental interval between the microphone 10 and the microphone 20, the frequency band of 4220 Hz to 8500 Hz is assigned to the fundamental interval. The frequency band of 2810 Hz to 4220 Hz corresponds to a microphone interval which is twice the fundamental interval. The frequency band of 2090 Hz to 2810 Hz corresponds to a microphone interval which is three times the fundamental interval. The frequency band of 1690 Hz to 2090 Hz corresponds to a microphone interval which is four times the fundamental interval. The frequency band of 1400 Hz to 1690 Hz corresponds to a microphone interval which is five times the fundamental interval. The frequency band of 0 Hz to 1400 Hz corresponds to a microphone interval which is six times the fundamental interval.

Figure 5:
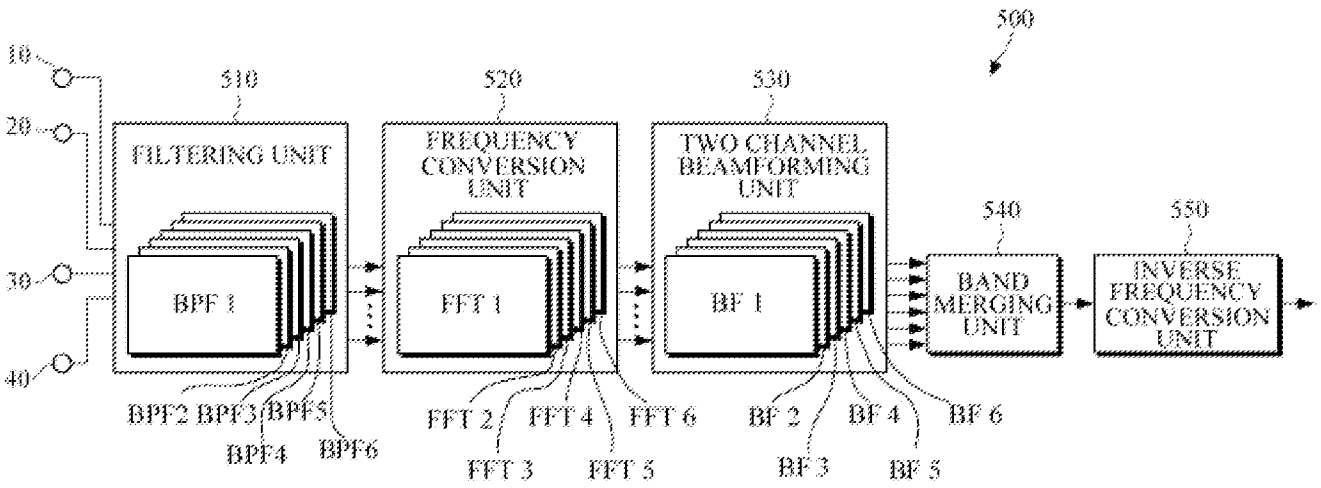
FIG. 5 illustrates an example of another apparatus for enhancing audio quality.

FIG. 5 is a view showing another example of an apparatus for enhancing audio quality.

An audio quality enhancing apparatus 500 includes a microphone array including a plurality of microphones 10, 20, 30, and 40, a filtering unit 510, a frequency conversion unit 520, a two channel beamforming unit 530, a merging unit 540, and an inverse frequency conversion unit 550. Unlike the audio quality enhancing apparatus 100 shown in FIG. 1, which performs a frequency band division and merging operation on acoustic signals in the frequency domain, the audio quality enhancing apparatus 500 of FIG. 5 performs a frequency band division operation on acoustic signals in the time domain and performs a frequency band merging operation on acoustic signals in frequency domain.

Similar to the microphone array shown in FIG. 1, the microphone array 501 of the audio quality enhancing apparatus 500 includes at least three microphones. In this example, four microphones 10, 20, 30, and 40 are disposed in a non-uniform configuration. The at least three microphones may be disposed such that redundant components for the intervals between the microphones 10, 20, 30 and 40 are minimized.

The filtering unit 510 includes a plurality of band-pass filters allowing acoustic signals, which are input from the microphones 10, 20, 30 and 40, to pass through respective frequency bands that are divided based on intervals of the microphones 10, 20, 30 and 40. The band-pass filters included in the filtering unit 510 are configured to pass acoustic signals of respective frequency bands which are divided as determined by the maximum frequency values that do not cause spatial aliasing for each interval between the microphones 10, 20, 30 and 40.

If the four microphones 10, 20, 30 and 40 of the audio quality enhancing apparatus 500 are disposed in the minimum redundant linear array configuration, the filtering unit 510 may include six band-pass filters BPF1, BPF2, BPF3, BPF4, BPF5, and BPF6.

The six band-pass filters BPF1, BPF2, BPF3, BPF4, BPF5, and BPF6 are configured to allow signals to pass through each of six frequency bands, which are divided based on the intervals between the microphones 10, 20, 30 and 40. In detail, the band-pass filter BPF1 may be configured to allow a first acoustic signal input from the microphone 10 and a second acoustic signal input from the microphone 20 in a frequency band of 4220 Hz to 8500 Hz to pass through. The band-pass filter BPF2 may be configured to allow a third acoustic signal input from the microphone 30 and a fourth acoustic signal input from the microphone 40 in a frequency band of 2810 Hz to 4220 Hz to pass through. The band-pass filter BPF3 may be configured to allow the second acoustic signal and the third acoustic signal in a frequency band of 2090 Hz to 2810 Hz to pass through. The band-pass filter BPF4 may be configured to allow the first acoustic signal and the third acoustic signal in a frequency band of 1690 Hz to 2090 Hz to pass through. The band-pass filter BPF5 may be configured to allow the second acoustic signal and the fourth acoustic signal in a frequency band of 1400 Hz to 1690 Hz to pass through. The band-pass filter BPF6 may be configured to allow the first acoustic signal and the fourth acoustic signal in a frequency band of 0 Hz to 1400 Hz to pass through.

The frequency conversion unit 520 transforms acoustic signals having passed through the filtering unit 510 into acoustic signals of the frequency domain. When processing acoustic signals input from the four microphones 10, 20, 30, and 40, the frequency conversion unit 520 receives twelve acoustic signals from the filtering unit 510 and transforms the received twelve acoustic signals into acoustic signals of the frequency domain. For example, pairs of acoustic signals are provided to six fast Fourier transformers (e.g., FFT1, FFT2, FFT3, FFT4, FFT5, FFT6) to covert pairs of acoustic signals using a fast Fourier transform to the frequency domain.

The two channel beamforming unit 530 performs two channel beamforming on the two acoustic signals for each frequency band. The two acoustic signals each pass through the same band filter from among the plurality of band-pass filters such that noise input from an unwanted direction (i.e., a direction other than the direction of a target sound) from the two signals is alleviated for each frequency band, thereby outputting noise reduced signals. The two channel beamforming unit 530 may include six beam formers BF1, BF2, BF3, BF4, BF5, and BF6.

The beam former BF1 may perform the two channel beamforming using the first acoustic signal and the second acoustic signal from the frequency band of 4220 Hz to 8500 Hz. The beam former BF2 may perform the two channel beamforming using the third acoustic signal and the fourth acoustic signal from the frequency band of 2810 Hz to 4220 Hz. The beam former BF3 may perform the two channel beamforming using the second acoustic signal and the third acoustic signal from the frequency band of 2090 Hz to 2810 Hz. The beam former BF4 may perform the two channel beamforming using the first acoustic signal and the third acoustic signal from the frequency band of 1690 Hz to 2090 Hz. The beam former BF5 may perform the two channel beamforming using the second acoustic signal and the fourth acoustic signal from the frequency band of 1400 Hz to 1690 Hz. The beam former BF6 may perform the two channel beamforming using the first acoustic signal and the fourth acoustic signal from the frequency band of 0 Hz to 1400 Hz.

The merging unit 540 merges each of the generated noise-reduced signals corresponding to the acoustic signals of each frequency band. According to this example, the merging unit 540 merges the six acoustic signals output from the beamforming unit 530, on which two channel beamforming has been performed for each frequency band, to acquire an acoustic signal for all frequencies of 0 Hz to 8500 Hz.

The frequency inverse conversion unit 550 transforms merged signals into acoustic signals of time domain.

Figure 6:
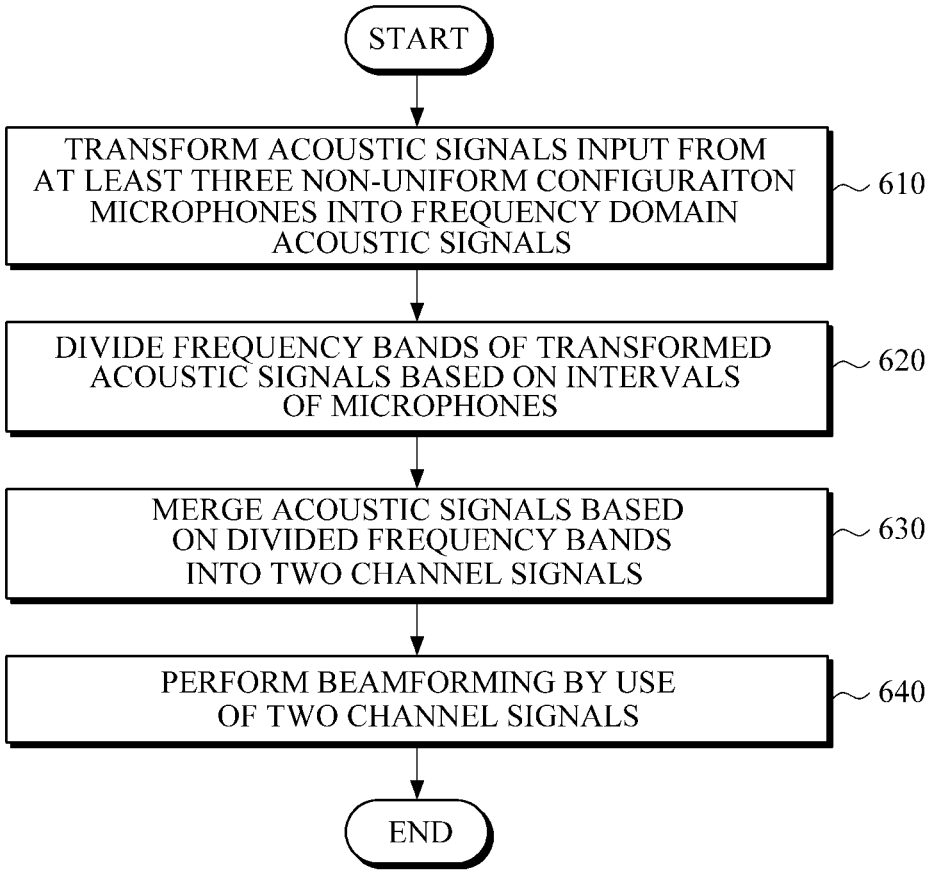
FIG. 6 illustrates an example of a method of enhancing audio quality.

FIG. 6 is a flowchart showing an example of a method of enhancing audio quality.

As shown in FIGS. 1 and 6, the audio quality enhancing apparatus 100 transforms acoustic signals that are input from at least three microphones disposed in a non-uniform configuration into acoustic signals of frequency domain (610). The at least three microphones may be disposed to minimize redundant components for the intervals of the microphones.

The audio quality enhancing apparatus 100 divides frequencies into bands for transformed acoustic signals based on the intervals between the microphones (620). The audio quality enhancing apparatus 100 may divide the frequencies into bands by use of the maximum frequency values that do not cause spatial aliasing for each interval of the microphones. The audio quality enhancing apparatus 100 determines the maximum frequency value ($f_o$) to be less than a value determined by dividing a sound velocity (c) by twice the interval between two microphones (d). In addition, the audio quality enhancing apparatus 100 determines the number of frequency bands to correspond to the number of the intervals of the microphones.

The audio quality enhancing apparatus 100 merges acoustic signals of the frequency domain into two channel signals based on the divided frequency bands (630). For all sets of intervals between the microphones, the audio quality enhancing apparatus 100 extracts acoustic signals of each frequency band input from the two microphones forming an interval and merges the extracted acoustic signals into acoustic signals of two channels.

The audio quality enhancing apparatus 100 performs two channel beamforming using the signals of the two channels to attenuate noise input from an unwanted direction (i.e., a direction other than the direction of a target sound) to output noise reduced signals (640).

Figure 7:
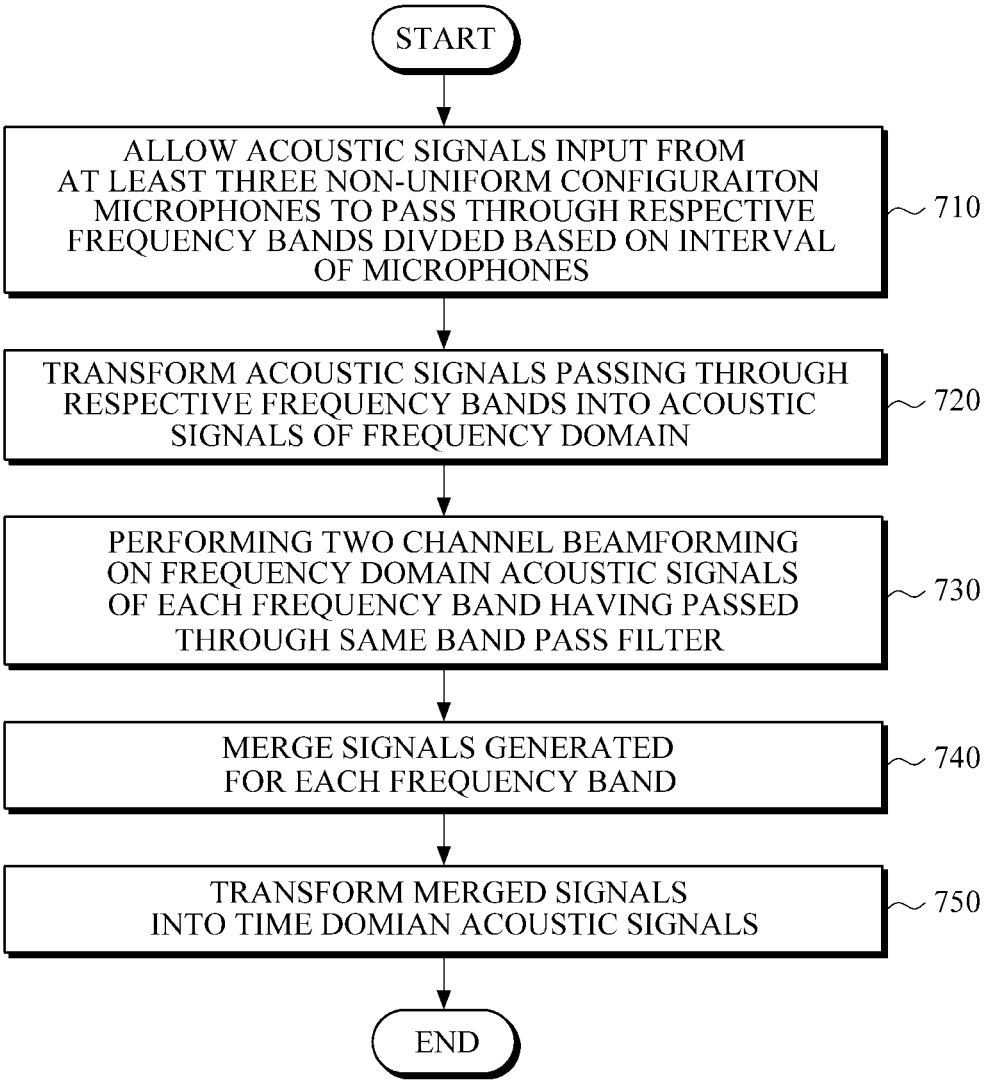
FIG. 7 illustrates an example of another method of enhancing audio quality.

FIG. 7 is a flowchart showing another example of a method of enhancing audio quality.

As shown in FIGS. 5 and 7, the audio quality enhancing apparatus 500 allows acoustic signals, which are input from at least three microphones disposed in non-uniform configuration, to pass through the respective frequency bands that are assigned based on the intervals between the microphones (710). The audio quality enhancing apparatus 500 passes acoustic signals through the respective frequency bands. The frequency bands are determined by use of the maximum frequency values that do not cause spatial aliasing for each respective interval between the microphones of the non-uniform configuration.

The audio quality enhancing apparatus 500 transforms the acoustic signals passing through each frequency band into acoustic signals of the frequency domain (720).

The audio quality enhancing apparatus 500 outputs noise reduced signals by performing two channel beamforming on the acoustic signals for each frequency band. The acoustic signals pass through the same band-pass filter in operation 710. The acoustic signals input from the at least three microphones disposed in a non-uniform configuration pass through respective frequency bands divided based on the intervals of the microphones. The two channel beamforming of the acoustic signals for each frequency band alleviate noise input from an unwanted direction (i.e., a direction other than the) direction of a target sound is alleviated (730).

The audio quality enhancing apparatus 500 merges the noise reduced signals generated corresponding to the acoustic signals of each frequency band (740).

The audio quality enhancing apparatus 500 transforms the merged acoustic signals into acoustic signals of time domain (750).

Figure 8:
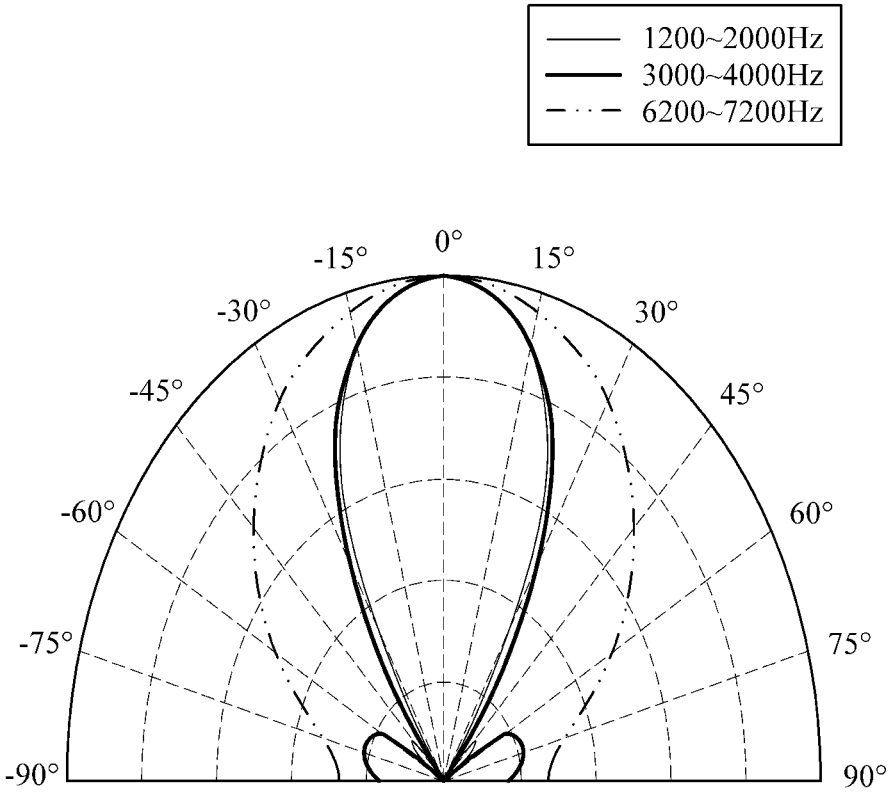
FIG. 8 illustrates an example of beam patterns generated according to an apparatus and a method of enhancing audio quality.

FIG. 8 is a view showing an example of beam patterns generated according to the apparatus and method of enhancing audio quality.

As shown in FIG. 8, according to the example of the apparatus and method for enhancing audio quality, beampatterns are equally formed at a broad frequency region, such as frequency bands of 1200 Hz to 2000 Hz, 3000 Hz to 4000 Hz, and 6200 Hz to 7200 Hz while avoiding omni-directional characteristics at lower frequency bands or grating lobes due to spatial aliasing at higher frequency bands. As described above, by using a microphone array disposed in a non-uniform configuration, even if the microphone array is provided in a small size, beampatterns having a desired direction may be obtained at a wide range of frequencies including higher frequency bands and lower frequency bands.

The units described herein may be implemented using hardware components and software components. For example, microphones, amplifiers, band-pass filters, audio to digital convertors, and processing devices. A processing device may be implemented using one or more general-purpose or special purpose computers, such as, for example, a processor, a controller and an arithmetic logic unit, a digital signal processor, a microcomputer, a field programmable array, a programmable logic unit, a microprocessor or any other device capable of responding to and executing instructions in a defined manner. The processing device may run an operating system (OS) and one or more software applications that run on the OS. The processing device also may access, store, manipulate, process, and create data in response to execution of the software. For purpose of simplicity, the description of a processing device is used as singular; however, one skilled in the art will appreciated that a processing device may include multiple processing elements and multiple types of processing elements. For example, a processing device may include multiple processors or a processor and a controller. In addition, different processing configurations are possible, such a parallel processors. As used herein, a processing device configured to implement a function A includes a processor programmed to run specific software. In addition, a processing device configured to implement a function A, a function B, and a function C may include configurations, such as, for example, a processor configured to implement both functions A, B, and C, a first processor configured to implement function A, and a second processor configured to implement functions B and C, a first processor to implement function A, a second processor configured to implement function B, and a third processor configured to implement function C, a first processor configured to implement function A, and a second processor configured to implement functions B and C, a first processor configured to implement functions A, B, C, and a second processor configured to implement functions A, B, and C, and so on.

The software may include a computer program, a piece of code, an instruction, or some combination thereof, for independently or collectively instructing or configuring the processing device to operate as desired. Software and data may be embodied permanently or temporarily in any type of machine, component, physical or virtual equipment, computer storage medium or device, or in a propagated signal wave capable of providing instructions or data to or being interpreted by the processing device. The software also may be distributed over network coupled computer systems so that the software is stored and executed in a distributed fashion. In particular, the software and data may be stored by one or more computer readable recording mediums. The computer readable recording medium may include any data storage device that can store data which can be thereafter read by a computer system or processing device. Examples of the computer readable recording medium include read-only memory (ROM), random-access memory (RAM), CD-ROMs, magnetic tapes, floppy disks, optical data storage devices.

Also, functional programs, codes, and code segments for accomplishing the present invention can be easily construed by programmers skilled in the art to which the present invention pertains based on and using the flow diagrams and block diagrams of the figures and their corresponding descriptions as provided herein. A number of exemplary embodiments have been described above. Nevertheless, it will be understood that various modifications may be made. For example, suitable results may be achieved if the described techniques are performed in a different order and/or if components in a described system, architecture, device, or circuit are combined in a different manner and/or replaced or supplemented by other components or their equivalents. Accordingly, other implementations are within the scope of the following claims.

What is claimed is:

1. An apparatus for enhancing audio quality, comprising:

at least three microphones which are disposed in a non-uniform configuration;

a band division and merging device configured to divide frequencies of acoustic signals input from the at least three microphones into bands based on intervals between the at least three microphones and configured to merge the acoustic signals in a frequency domain into multi-channel signals based on the divided frequency bands; and a noise reducer configured to reduce noise of the acoustic signals by performing beamforming on the multi-channel signals.

2. The apparatus of claim 1, wherein the at least three microphones are disposed according to a minimum redundant linear array configuration that minimizes a redundant component for an interval between the at least three microphones.

3. The apparatus of claim 1, wherein, when the band division and merging device divides the frequencies into bands for the acoustic signals based on the respective intervals of the at least three microphones, the frequency bands are assigned using a maximum frequency value that does not cause spatial aliasing for each corresponding interval of the at least three microphones.

4. The apparatus of claim 3, wherein the band division and merging device determines the maximum frequency value ($f_o$) of a band to be less than a value obtained by dividing a sound velocity (c) by twice the interval between the corresponding microphones (d).

5. The apparatus of claim 1, wherein the number of frequency bands configured by the band division and merging device are determined to correspond to the number of intervals of various pairs of the at least three microphones.

6. The apparatus of claim 1, wherein the band division and merging device is further configured to extract acoustic signals in the frequency domain that are input from a set of two of the at least three microphones forming an interval for all sets of intervals of the at least three microphones of each frequency band and to merge the extracted acoustic signals into multi-channel acoustic signals.

7. The apparatus of claim 1, further comprising:

a frequency converter configured to transform acoustic signals input from the at least three microphones to acoustic signals of the frequency domain; and an inverse frequency converter configured to transform the output noise-reduced signals into acoustic signals of a time domain.

8. The apparatus of claim 1, wherein the noise of the acoustic signals includes input from a direction other than a direction of a target sound.

9. The apparatus of claim 1, wherein the multi-channel signals are two channel signals.

10. An apparatus for enhancing audio quality, comprising:

at least three microphones disposed in a non-uniform configuration;

a filtering device including a plurality of band-pass filters configured to allow acoustic signals input from the at least three microphones to pass through respective frequency bands of the plurality of band-pass filters, wherein the range of frequencies corresponding to each band-pass filter is determined based on intervals between the at least three microphones;

a noise reducer configured to reduce noise input from a direction other than a direction of a target sound of acoustic signals of two channels for each frequency band, the acoustic signals having passed through a same band-pass filter among the plurality of band-pass filters; and a merging device configured to merge the noise reduced acoustic signals output for each frequency band.

11. The apparatus of claim 10, wherein the at least three microphones are configured according to a minimum redundant linear array to minimize a redundant component for the intervals of the at least three microphones.

12. The apparatus of claim 10, wherein the range of frequencies corresponding to each band-pass filter included in the filtering unit are determined by use of maximum frequency values that do not cause spatial aliasing for each corresponding interval of the at least three microphones.

13. A method of enhancing audio quality of an acoustic array, comprising:

dividing a range of frequencies of acoustic signals input from at least three microphones disposed in a non-uniform configuration into frequency bands based on intervals between the microphones;

merging the acoustic signals of a frequency domain into multi-channel signals based on the frequency bands; and reducing noise of the acoustic signals input from a direction other than a direction of a target sound by use of the multi-channel signals.

14. The method of claim 13, wherein the at least three microphones are configured according to a minimum redundant linear array to minimize a redundant component for the intervals of the at least three microphones.

15. The method of claim 13, wherein dividing the range of frequencies of the acoustic signals of frequency domain into frequency bands based on intervals between the microphones further comprises determining the frequency bands by use of a maximum frequency value that does not cause spatial aliasing for each corresponding interval of the microphones.

16. The method of claim 15, wherein determining the frequency bands by use of a maximum frequency value that does not cause spatial aliasing for each corresponding interval of the microphones comprises determining the maximum frequency value ($f_o$) of a band to be less than a value obtained by dividing a sound velocity (c) by twice a corresponding interval of microphones (d).

17. The method of claim 13, wherein dividing the range of frequencies of the acoustic signals of frequency domain into frequency bands based on intervals between the microphones comprises dividing the frequency range of frequencies into bands corresponding to the number of intervals of the microphones.

18. The method of claim 13, wherein merging the acoustic signals of the frequency domain into multi-channel signals comprises:

extracting acoustic signals in the frequency domain that are input from a set of two of the at least three microphones forming an interval for all sets of intervals of the at least three microphones of each frequency band; and merging the extracted acoustic signals into multi-channel acoustic signals.

19. The method of claim 13, further comprising:

transforming acoustic signals input from the at least three microphones disposed in the non-uniform configuration into acoustic signal of a frequency domain; and transforming the output noise-reduced signals into acoustic signals of a time domain.

20. The method of claim 13, wherein the multi-channel signals are two channel signals.

21. A method of enhancing audio quality of an acoustic array including at least three microphones disposed in a non-uniform configuration, comprising:

allowing acoustic signals input from the at least three microphones to pass through respective frequency bands of a plurality of band-pass filters, wherein the range of frequencies corresponding to each band-pass filter is determined based on intervals between the at least three microphones;

reducing noise input from direction other than a direction of a target sound of acoustic signals of two channels for each frequency band, the acoustic signals having passed through a same band-pass filter among the plurality of band-pass filters; and merging the noise-reduced acoustic signals output for each frequency band.

22. The method of claim 21, wherein the at least three microphones are configured according to a minimum redundant linear array to minimize a redundant component for the intervals of the at least three microphones.

23. The method of claim 21, wherein the allowing of the acoustic signals to pass through the respective frequency bands comprises:

passing acoustic signals through the respective frequency bands that are determined by use of the maximum frequency value that does not cause spatial aliasing for each corresponding interval of the at least three microphones.

* * * * *